US012486622B2

(12) United States Patent
Muehlbacher

(10) Patent No.: US 12,486,622 B2
(45) Date of Patent: Dec. 2, 2025

(54) HAND-HELD TAMPING MACHINE FOR COMPACTING TRACK BALLAST

(71) Applicant: ROBEL Bahnbaumaschinen GmbH, Freilassing (DE)

(72) Inventor: Florian Muehlbacher, Waging (DE)

(73) Assignee: ROBEL Bahnbaumaschinen GmbH, Freilassing (DE)

( * ) Notice: Subject to any disclaimer, the term of this patent is extended or adjusted under 35 U.S.C. 154(b) by 743 days.

(21) Appl. No.: 17/824,251

(22) Filed: May 25, 2022

(65) Prior Publication Data

US 2022/0380986 A1 Dec. 1, 2022

(30) Foreign Application Priority Data

May 28, 2021 (DE) ..... 10 2021 205 469.2

(51) Int. Cl.
*E01B 27/14* (2006.01)

(52) U.S. Cl.
CPC ..... *E01B 27/14* (2013.01)

(58) Field of Classification Search
CPC ..... E01B 27/028; E01B 27/14; E01B 27/16
USPC ..... 104/13; 404/133.1
See application file for complete search history.

(56) References Cited

U.S. PATENT DOCUMENTS

| | | | | | |
|---|---|---|---|---|---|
| 1,341,945 | A * | 6/1920 | Study | E01B 27/14 | 104/13 |
| 1,431,808 | A * | 10/1922 | Corwill | E01B 27/14 | 173/162.1 |
| 4,014,620 | A * | 3/1977 | Vural | E02D 3/068 | 404/133.1 |
| 4,186,197 | A * | 1/1980 | Tetsuo | E02D 3/068 | 404/133.1 |
| 2021/0230810 | A1* | 7/2021 | Widlroither | E01B 27/20 | |

FOREIGN PATENT DOCUMENTS

| | | | | |
|---|---|---|---|---|
| CN | 201040818 | Y | 3/2008 | |
| CN | 203487421 | U | 3/2014 | |
| CN | 104264541 | B * | 11/2016 | E01B 27/14 |
| CN | 211171454 | U | 8/2020 | |
| EP | 3056606 | A1 | 8/2016 | |
| SU | 1051151 | A1 | 10/1983 | |
| WO | 2012139687 | A1 | 10/2012 | |
| WO | 2020020448 | A1 | 1/2020 | |

* cited by examiner

*Primary Examiner* — Gary S Hartmann
(74) *Attorney, Agent, or Firm* — Laurence A. Greenberg; Werner H. Stemer; Ralph E. Locher

(57) ABSTRACT

A hand-held tamping machine for compacting track ballast has a tamping pick for penetrating the track ballast, a vibration generator for vibration excitation of the tamping pick, a motor connected with the vibration generator via a drive shaft, and a handle assembly with at least one handle for steering the hand-held tamping machine during operation. Along a shaft axis of the drive shaft the at least one handle is arranged above the machine center of gravity of the hand-held tamping machine by at least 30% of the overall height of the hand-held tamping machine and/or is arranged above the motor center of gravity of the motor by at least 15% of the overall height of the hand-held tamping machine.

17 Claims, 2 Drawing Sheets

HAND-HELD TAMPING MACHINE FOR COMPACTING TRACK BALLAST

CROSS-REFERENCE TO RELATED APPLICATION

This application claims the priority, under 35 U.S.C. § 119, of German Patent Application DE 10 2021 205 469.2, filed May 28, 2021; the prior application is herewith incorporated by reference in its entirety.

FIELD AND BACKGROUND OF THE INVENTION

The invention relates to a hand-held tamping machine for compacting track ballast.

A hand-held tamping machine for compacting track ballast is known from published international patent application WO 2012/139 687 A1. The hand-held tamping machine comprises a tamping pick for penetrating the track ballast, a vibration generator, a combustion motor for driving the vibration generator in rotation, and handles for steering the hand-held tamping machine during operation. Vibration dampers act between the vibration generator and the handles. However, the vibrations transmitted to the handles cannot be completely cancelled out and are stressful for the user. Noise and exhaust emissions generated by the combustion motor are an additional burden for the user.

SUMMARY OF THE INVENTION

It is an object of the invention to improve a hand-held tamping machine for compacting track ballast, in particular to increase its ease of use and to reduce the stresses it imposes on the user.

With the above and other objects in view there is provided, in accordance with the invention, a hand-held tamping machine for compacting track ballast. The machine includes at least the following:

- a tamping pick for penetrating the track ballast;
- a vibration generator for exciting the tamping pick in vibration;
- a motor which is connected with the vibration generator via a drive shaft;
- a handle assembly having at least one handle for steering the hand-held tamping machine during operation, wherein along a shaft axis of the drive shaft, the at least one handle,
- is arranged above the machine center of gravity of the hand-held tamping machine by at least 30% of the overall height of the hand-held tamping machine; and/or
- is arranged above the motor center of gravity of the motor by at least 15% of the overall height of the hand-held tamping machine.

It has been found that a hand-held tamping machine has a particularly beneficial ease of use if, along a shaft axis of a drive shaft connecting the motor to the vibration generator, at least one handle for steering the hand-held tamping machine is arranged above the machine center of gravity of the hand-held tamping machine by at least 30% of the overall height of the hand-held tamping machine and/or is arranged above the motor center of gravity of the motor by at least 15% of the overall height of the hand-held tamping machine. The arrangement of the at least one handle above the motor center of gravity has the effect that the user's head can be kept particularly far away from the noise and/or pollutant producing motor. It is true that the motor is closer to the vibration generator due to its low-lying arrangement. Surprisingly, however, it has been found that this does not necessarily subject the motor to higher vibration loads. On the contrary, the arrangement closer to the machine center of gravity may result in higher inertial damping, which may even reduce the vibrations transmitted to the motor.

The lower machine center of gravity with respect to the at least one handle facilitates the steering of the hand-held tamping machine. In order to tamp the track ballast under a track sleeper, the hand-held tamping machine penetrating the track ballast is swiveled about a horizontal axis. It is true that a corresponding swiveling motion of the hand-held tamping machine from the vertical orientation is supported by a high machine center of gravity. However, it has been found that the mass to be moved by the user, and thus the total energy to be applied by the user, can be reduced by the lower machine center of gravity, thus causing the user to reach fatigue less quickly. Furthermore, the longer lever arm provides better control over the hand-held tamping machine with respect to the machine center of gravity.

A particular advantage of the hand-held tamping machine according to the invention is that the vibrations prevailing at the at least one handle during operation and the associated stresses on the user are particularly low. Due to the particularly low arrangement of the machine center of gravity with respect to the at least one handle, a vibration nodal point of a rigid-body vibration excited by the vibration generator can be displaced to be particularly close to the at least one handle. At the at least one handle, the resulting vibration amplitude is thus particularly low. Circulatory disorders and muscle diseases associated with continuous vibration stress can thus be prevented.

In connection with position and dimension specifications, reference is made to the main orientation of the hand-held tamping machine during operation, in which the drive axis is oriented vertically. In this operating state, the tamping pick points downwards in the vertical direction. Distances with respect to the at least one handle are measured to the upper side of the handle, unless otherwise specified. The shaft axis is preferably arranged coaxially to the central longitudinal axis and/or to the vertical axis of the hand-held tamping machine. The machine center of gravity is understood to be the center of gravity of the hand-held tamping machine, in particular in a ready-to-use state of the hand-held tamping machine. In this state, for example, a fuel tank of the motor is half-filled and a ballast contact attachment, which is preferably construed to be exchangeable, is attached to the hand-held tamping machine. Steering the hand-held tamping machine in operation is understood to mean holding and displacing the hand-held tamping machine while compacting the track ballast and/or carrying the hand-held tamping machine to the position of the track ballast to be processed. The term "above" refers in particular to the direction towards the at least one handle.

The handle assembly preferably has at least two handles, in particular exactly two, or at least three, in particular at least four, handles. Preferably, the position specifications made in connection with the at least one handle apply to all of the handles. The at least one handle may be formed by a carrying structure and/or attached thereto. Preferably, the respective handle comprises a vibration-damping material, in particular a plastic material and/or a rubber-elastic material. A power adjustment element, in particular a throttle lever, for regulating the power output by the motor can be arranged at the at least one handle, in particular such that the user does not have to release the hand from the handle to actuate the power adjustment element.

Preferably, the tamping pick comprises an attachment support and a ballast contact attachment that can be detachably attached to the attachment support. The ballast contact attachment, which is subjected to high stresses as a result of contact with the track ballast, can thus be easily replaced.

The tamping pick, in particular the attachment support, is preferably configured so as to be hollow, in particular tubular. The attachment support may be configured as a tamping pick tube. According to one aspect of the invention, the vibration generator is arranged at least in sections within the tamping pick tube or tubular tamping pick. An imbalance mass of the vibration generator may be completely arranged within the tamping pick tube and/or completely overlapped by the tamping pick tube along a direction perpendicular to the shaft axis.

The vibration generator is preferably configured such that the forces generated for the vibration excitation of the tamping pick act so as to be perpendicular to the shaft axis, in particular in the horizontal direction. The transmission of vibrations oriented as to be perpendicular to the shaft axis to the at least one handle and/or the motor is particularly strongly inhibited in the hand-held tamping machine according to the invention.

Following one after the other in the vertical direction, the hand-held tamping machine preferably comprises the at least one handle, the motor center of gravity, the machine center of gravity, and a tip of the tamping pick. A vibration nodal point can thereby be arranged along the shaft axis particularly close to the at least one handle.

Preferably, the overall height of the hand-held tamping machine and/or the distance between the at least one handle and the underside of the tamping pick are in a range from 850 mm to 1250 mm, in particular from 950 mm to 1150 mm, in particular from 1000 mm to 1100 mm.

A hand-held tamping machine configured such that along the shaft axis the at least one handle is arranged above the machine center of gravity by at least 40% of the overall height of the hand-held tamping machine is particularly operator-friendly. The vibrational motions transmitted to the at least one handle are further reduced. The hand-held tamping machine is even easier to steer during operation. The machine center of gravity, in particular along the shaft axis of the drive shaft, is preferably arranged in a range from 30% to 70%, in particular from 35% to 65%, in particular from 40% to 60%, in particular from 45% to 55%, of the overall height of the hand-held tamping machine below the at least one handle, in particular below all handles.

A hand-held tamping machine configured such that along the shaft axis the machine center of gravity is arranged at a maximum of 60% of the overall height of the hand-held tamping machine below the at least one handle has a particularly high ease of use. Due to the arrangement of the machine center of gravity at a maximum of 60% of the overall height of the hand-held tamping machine below the at least one handle, the vibrations transmitted to the at least one handle are particularly low due to inertial damping by the machine mass. Along the shaft axis of the drive shaft, the at least one handle is preferably arranged above the machine center of gravity by a maximum of 65%, in particular a maximum of 60%, in particular a maximum of 55%, in particular a maximum of 50%, in particular a maximum of 45%, of the overall height of the hand-held tamping machine. Along the drive shaft, the at least one handle is preferably arranged by a maximum of 50%, in particular a maximum of 45%, in particular a maximum of 40%, in particular a maximum of 35%, in particular a maximum of 30%, in particular a maximum of 25%, above the motor center of gravity of the motor. As a result, a particularly high ease of use can be achieved.

A hand-held tamping machine configured such that along the shaft axis the at least one handle is arranged above the motor center of gravity by at least 20% of the overall height of the hand-held tamping machine is particularly operator-friendly. Due to the arrangement of the motor center of gravity far away from the at least one handle, the user is less intensely exposed to noise and/or exhaust emissions, in the case of an internal combustion engine. Vibrations which emanate from the motor are transmitted less strongly to the at least one handle due to the greater proximity to the machine center of gravity and the resulting greater inertial damping. Preferably, the motor center of gravity is arranged along the shaft axis in a range from 15% to 50%, in particular from 20% to 40%, in particular from 25% to 30%, of the overall height of the hand-held tamping machine below the at least one, in particular all, handles.

A hand-held tamping machine configured such that along the shaft axis a distance between the at least one handle and a vibration nodal point of the hand-held tamping machine due to the vibration excitation by the vibration generator is a maximum of 15% of the overall height of the hand-held tamping machine has a particularly high ease of use. The stress on the user caused by vibrations transmitted to the at least one handle is particularly low. The vibration nodal point is preferably one, in particular the only, vibration nodal point of a rigid-body motion of the hand-held tamping machine caused by the vibration excitation of the vibration generator. Alternatively, this may be a vibration nodal point due to an elastic deformation of the hand-held tamping machine and/or an inherent mode of vibration of the hand-held tamping machine. The at least one handle is arranged along the shaft axis preferably at a maximum distance of 15%, in particular at a maximum distance of 10%, in particular at a maximum distance of 5%, of the overall height of the hand-held tamping machine from the vibration nodal point.

According to another aspect of the invention, the motor center of gravity is arranged along the shaft axis at a maximum distance of 15%, in particular at a maximum distance of 10%, in particular at a maximum distance of 5%, of the overall height of the hand-held tamping machine from a vibration nodal point of the hand-held tamping machine due to vibration excitation by the vibration generator. As a result, the vibration loads transmitted to the motor can be reduced.

A hand-held tamping machine configured such that the vibration nodal point is caused by a rigid-body motion and/or an elastic deformation of the hand-held tamping machine has a particularly high ease of use. The stress on the user caused by vibrations transmitted to the at least one handle is particularly low. In particular, the vibration amplitude excited during operation of the hand-held tamping machine in the region of the at least one handle is especially low. The vibration nodal point is preferably detected in an operating state of the hand-held tamping machine in which no external forces act on the hand-held tamping machine and/or when the tamping pick has penetrated the track ballast and/or when the tamping pick, in particular a tip of the tamping pick, is fixed, in particular fixed in position and/or fixed in orientation.

A hand-held tamping machine comprising a first vibration decoupler which acts between the tamping pick and the handle assembly and/or the motor has a particularly high ease of use. The first vibration decoupler preferably comprises a vibration damper. The first vibration decoupler may have, in particular for connecting the handle assembly and/or the motor with the tamping pick and/or the vibration generator, at least one decoupling element, in particular an elastic element and/or a damping element, in particular a rubber-elastic body. Preferably, the first vibration decoupler acts between the handle assembly and/or the motor and the tamping pick and/or the vibration generator and/or between the handle assembly and the motor. According to one aspect of the invention, the first vibration decoupler enables limited relative movement between the handle assembly and/or the motor and the tamping pick and/or the vibration generator and/or between the handle assembly and the motor in a horizontal direction and/or in a vertical direction. This allows the at least one handle and/or the motor to be decoupled from a vibration of the tamping pick and/or the vibration generator.

A hand-held tamping machine configured such that a handle-side connection point and/or a tamping-pick-side connection point of the first vibration decoupler are arranged above the machine center of gravity has a particularly high ease of use. Due to the arrangement of the handle-side connection point and/or the tamping-pick-side connection point of the first vibration decoupler above the machine center of gravity, the connection point is particularly far away from the tamping pick, in particular from the decisive vibration source of the hand tamping device. In addition, this connection point is arranged opposite the tamping pick with respect to the center of mass, whereby vibrations at the at least one handle are reduced in a particularly comprehensive manner by the particularly strong inertial damping in the region of the machine center of gravity. The damping effect is increased and the vibration load acting on the user is reduced.

A hand-held tamping machine configured such that a distance of the at least one handle from the motor center of gravity and a distance of the motor center of gravity from a handle-side connection point of the first vibration decoupler are in a ratio in the range of 1:1 to 4:1 ensures a particularly beneficial ease of use. The motor center of gravity and the handle-side connection point of the first vibration decoupler are arranged along the shaft axis preferably between the at least one handle and the machine center of gravity. This reduces the vibrations transmitted to the motor and/or the handle assembly. The vibrations excited at the at least one handle are particularly low if the ratio between the distance of the at least one handle from the motor center of gravity and the distance of the motor center of gravity from the handle-side connection point of the first vibration decoupler is in a range from 1:1 to 4:1, in particular from 1.5:1 to 3.5:1, in particular from 2:1 to 3:1. With this arrangement, it is advantageously achieved that the mass of the motor exerts a particularly high inertial damping effect on the handle assembly.

A hand-held tamping machine configured such that along the shaft axis a distance between a tamping-pick-side connection point of the first vibration decoupler and the machine center of gravity is a maximum of 15% of the overall height of the hand-held tamping machine has a particularly high ease of use. The tamping-pick-side connection point of the first vibration decoupler can be arranged above or below the machine center of gravity. The distance between the tamping-pick-side connection point of the first vibration decoupler and the machine center of gravity is preferably a maximum of 15%, in particular a maximum of 10%, especially a maximum of 5%, of the overall height of the hand-held tamping machine. In the region of the machine center of gravity, the hand-held tamping machine experiences particularly high inertial damping. A particularly strong reduction in the vibration transmitted to the handle assembly and/or the motor via the tamping-pick-side connection point of the first vibration decoupler can be achieved with such an arrangement.

A hand-held tamping machine configured such that along the shaft axis a distance between a handle-side connection point of the first vibration decoupler and the machine center of gravity is a maximum of 20% of the overall height of the hand-held tamping machine has a particularly high ease of use during operation. Preferably, the distance along the shaft axis between the handle-side connection point of the first vibration decoupler and the machine center of gravity is a maximum of 20%, in particular a maximum of 15%, in particular a maximum of 10%, in particular a maximum of 5% of the overall height of the hand-held tamping machine. The handle-side connection point of the first vibration decoupler is arranged along the shaft axis preferably between the at least one handle and the machine center of gravity and/or above the tamping-pick-side connection point of the first vibration decoupler. The inertial damping due to the mass of the hand-held tamping machine thus has a particularly strong effect on reducing the vibrations at the at least one handle.

A hand-held tamping machine configured such that the first vibration decoupler and/or a second vibration decoupler are arranged completely above the machine center of gravity is particularly convenient to operate. Due to the fact that the first and/or the second vibration decoupler are arranged opposite the tamping pick and/or the vibration generator with respect to the machine center of gravity, the vibrations transmitted thereto are reduced, in particular due to the particularly strong inertial damping in the region of the machine center of gravity. Correspondingly, the vibrations transmitted to the motor and/or the at least one handle are reduced.

A hand-held tamping machine comprising a second vibration decoupler which acts between the handle assembly and the tamping pick and/or the motor ensures even lower vibrations at the at least one handle. The hand-held tamping machine may have the first vibration decoupler and/or the second vibration decoupler. The second vibration decoupler may be arranged above or below the first vibration decoupler or overlap the first vibration decoupler along the shaft axis. The second vibration decoupler may be substantially configured to correspond to the first vibration decoupler. Preferably, the second vibration decoupler is connected with the second vibration decoupler via a rigid head support structure, in particular a supporting plate. Preferably, the second vibration decoupler acts between the handle assembly and/or the motor and the tamping pick and/or the vibration generator and/or between the handle assembly and the motor. The second vibration decoupler can release a limited relative movement between the at least one handle and the tamping pick and/or the vibration generator and/or the motor and/or between the motor and the tamping pick and/or the vibration generator, in particular in any horizontal direction and/or in the vertical direction. The second vibration decoupler may have at least one decoupling element, in particular a spring element and/or a damping element, in particular a rubber-elastic element. Preferably, the first and/or the second vibration decoupler have a plurality of the decoupling elements.

A hand-held tamping machine configured such that the motor is a combustion engine or an electric motor is particularly flexible in use. Preferably, the hand-held tamping machine comprises an energy source, in particular a fuel tank for supplying the combustion engine with fuel or an accumulator or battery for supplying the electric motor with electric power.

A hand-held tamping machine configured such that the vibration generator is arranged at least in sections in a tamping pick tube enables compacting of the track ballast in a particularly time- and energy-efficient manner. The vibration generator can have an imbalance mass arranged eccentrically to the shaft axis, in particular arranged completely inside the tamping pick, in particular inside a tamping pick tube. This allows the vibration excitation to take place particularly close to the track ballast, which means that the kinetic energy applied can be dissipated to the track ballast largely without loss. The vibration excitation of the at least one handle and the motor, on the other hand, is reduced.

Other features which are considered as characteristic for the invention are set forth in the appended claims.

Although the invention is illustrated and described herein as embodied in a hand-held tamping machine for compacting track ballast, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
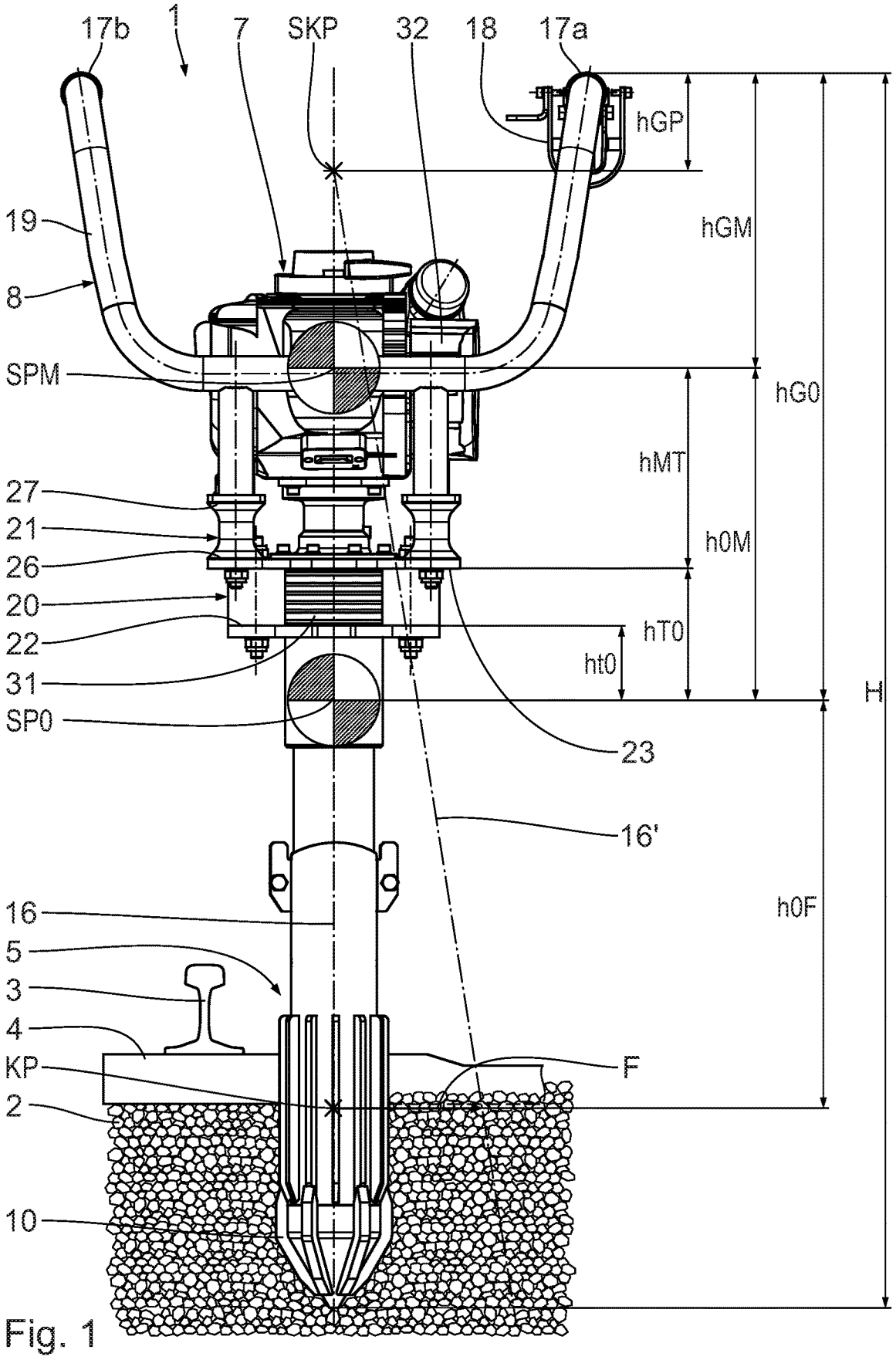
FIG. 1 is a front elevation view of a hand-held tamping machine for compacting track ballast, having a tamping pick for penetrating the track ballast, a vibration generator, a motor for driving the vibration generator in rotation, and a handle assembly for steering the hand-held tamping machine in operation.
Figure 2:
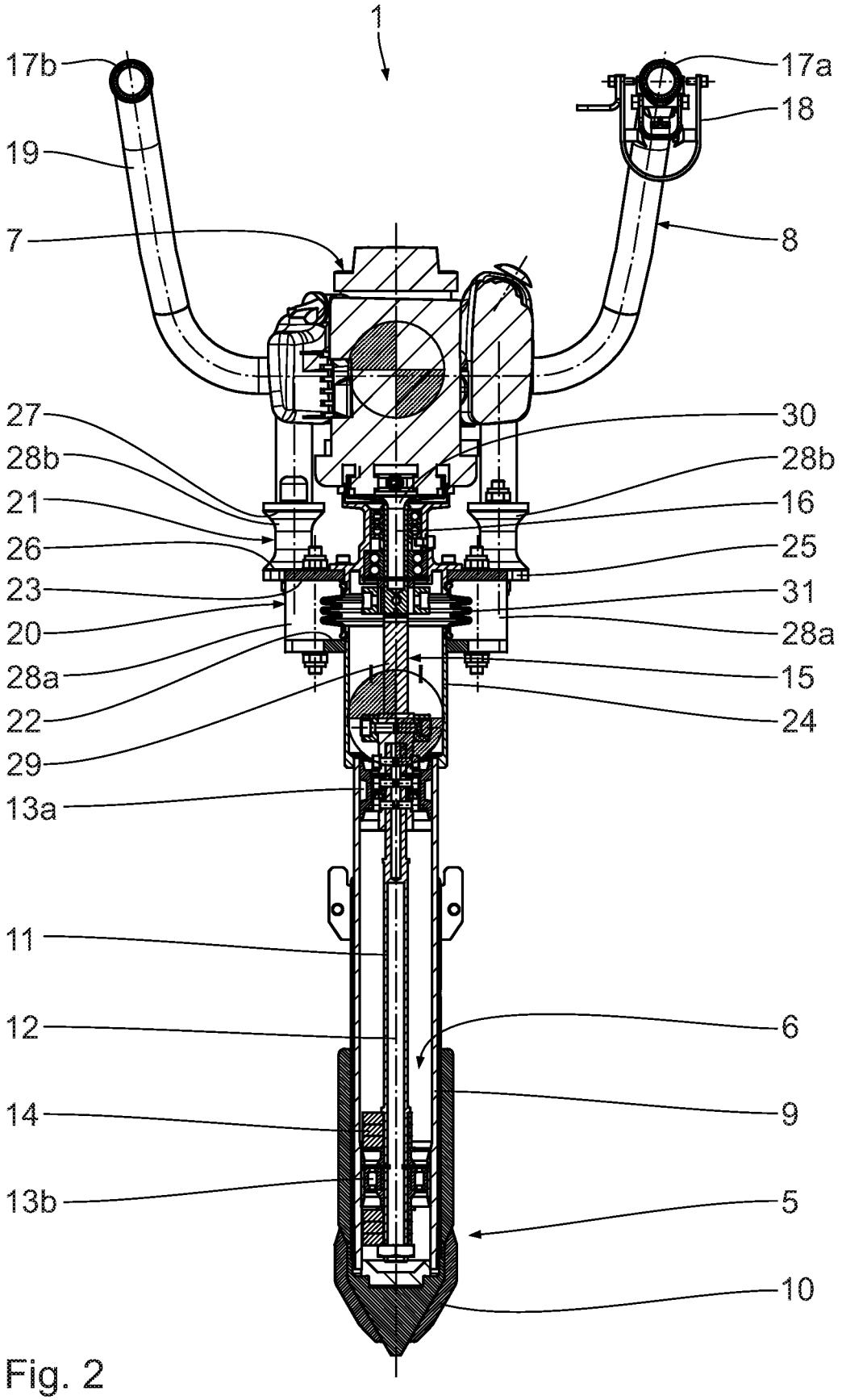
FIG. 2 is a longitudinal sectional view of the hand-held tamping machine of FIG. 1 through an axis of rotation of a drive shaft, which connects the motor to the vibration generator in a torque-transmitting manner.

Referring now to the figures of the drawing in detail, there is shown a hand-held tamping machine 1 for compacting track ballast 2. Track rails 3 are attached to track sleepers 4, which rest on the track ballast 2. In FIG. 1, the hand-held tamping machine 1 is shown in operation, with the hand-held tamping machine 1 penetrating the track ballast 2 in a vertical orientation to a depth below the track sleepers 4 for compacting the track ballast 2.

The hand-held tamping machine 1 has a tamping pick 5, a vibration generator 6, a motor 7 and a handle assembly 8. The tamping pick 5 comprises a tamping pick tube 9 and a ballast contact attachment 10 which surrounds the tamping pick tube 9 at least in sections. The ballast contact attachment 10, which is subject to wear, is replaceably attached to the tamping pick tube 9.

The vibration generator 6 is configured to excite the tamping pick 5 to vibrate. The motor 7 and the vibration generator 6 are configured to induce a vibration frequency in a range from 20 Hz to 100 Hz, in particular from 30 Hz to 60 Hz. The vibration generator 6 has an eccentric shaft 11 which is rotatably mounted in the tamping pick tube 9 about an eccentric axis 12 by means of two tubular bearings 13*a*, 13*b*. An imbalance mass 14 is attached to the eccentric shaft 11. In a direction perpendicular to the eccentric axis 12, the imbalance mass 14 is completely overlapped by the tamping pick tube 9 and the ballast contact attachment 10.

The engine 7 is an internal combustion engine, in particular a gasoline-driven engine. Alternatively, the motor 7 may also be configured as an electric motor. In order to drive the vibration generator 6 in rotation, the motor 7 is connected to it via a drive shaft 15. The drive shaft 15 is rotatably mounted about a shaft axis 16. The drive shaft 15 is connected with the eccentric shaft 11 in a reversibly detachable and torque-transmitting manner. The drive shaft 15 can alternatively be non-detachably connected with the eccentric shaft 11, in particular be configured as one piece with it. The eccentric shaft 11 and the drive shaft 15 are configured coaxially.

The handle assembly 8 has two handles 17*a*, 17*b*. The handles 17*a*, 17*b* comprise a plastic material, in particular they are configured as rubber handles. The motor 7 has a power adjustment element 18, in particular a throttle lever, for regulating the power output. The power adjustment element 18 is arranged at the first handle 17*a* such that the user does not have to take his hand off the handle 17*a* to adjust the motor power.

The handles 17*a*, 17*b* are connected with the motor 7 and the tamping pick 5 via a support structure 19. The support structure 19 is a tubular structure which is basically made of metal.

The hand-held tamping machine 1 has a first vibration decoupler 20 and a second vibration decoupler 21. The first vibration decoupler 20 acts between the tamping pick 5 and the handle assembly 8 and the motor 7. For this purpose, the first vibration decoupler 20 is connected to the tamping pick 5 via a tamping-pick-side connection point 22. A handle-side connection point 23 of the first vibration decoupler 20 is connected with the handle assembly 8 and the motor 7. In particular, the first vibration decoupler 20 is attached to a pick support structure 24 via the tamping-pick-side connection point 22. The first vibration decoupler 20 is attached to a head support structure 25 via the handle-side connection point 23. The head support structure 25 is configured as a supporting plate. The motor 7 is attached, in particular rigidly, to the head support structure 25.

The second vibration decoupler 21 acts between the handle assembly 8 and the tamping pick 5 as well as the motor 7, in particular the head support structure 25. For this purpose, the second vibration decoupler 21 is connected with the tamping pick 5 via a tamping-pick-side connection point 26, in particular attached to the head support structure 25. The second vibration decoupler 21 is connected with the handle assembly 8, in particular attached to the support structure 10, via a handle-side connection point 27.

Each of the first vibration decoupler 20 and the second vibration decoupler 21 comprises four decoupling elements 28*a*, 28*b*, respectively, made of a rubber-elastic material. The decoupling elements 28*a* of the first vibration decoupler are connected in parallel with each other. The decoupling elements 28*b* of the second vibration decoupler 21 are also connected in parallel with each other. The second vibration decoupler 21 is connected in series with the first vibration decoupler 20.

The two vibration decouplers 20, 21 each allow limited relative movement of the tamping-pick-side connection points 22, 26 with respect to the handle-side connection points 23, 27 in all spatial directions.

For power transmission between the motor 5 and the vibration generator 6 while tolerating corresponding relative movements, the drive shaft 15 is configured in two portions. A third vibration decoupler 31 acts between a first drive shaft portion 29 and a second drive shaft portion 30. The first drive shaft portion 29 is connected to the second drive shaft portion 30 via the third vibration decoupler 31 in a torque-transmitting manner. The third vibration decoupler 31 allows a limited displacement of the first drive shaft portion 29 relative to the second drive shaft portion 30 along the shaft axis 16, and a limited relative swiveling movement about any axis perpendicular to the shaft axis 16.

The hand-held tamping machine 1 has an overall height H of 1060 mm, which corresponds to the overall dimension of the hand-held tamping machine 1 along the shaft axis 16. A machine center of gravity SP0 is located along the shaft axis 16 in the center of the hand-held tamping machine 1. The machine center of gravity SP0 is arranged at a distance hG0 of 530 mm from the handles 17*a*, 17*b*.

Distances with respect to the at least one handle 17*a*, 17*b* are measured towards the upper side of the handle 17*a*, 17*b*. In general, when determining the masses and dimensions of the hand-held tamping machine 1, it is assumed that the hand-held tamping machine 1 is in an operational state, in which in particular the ballast contact attachment 10 is attached to the tamping pick tube 9 and/or a fuel tank 32 of the motor 7 is, say, half-way filled with fuel.

A motor center of gravity SPM is arranged below the handles 17*a*, 17*b* at a distance hGM of 240 mm from the handles 17*a*, 17*b*. Accordingly, a distance h0M between the machine center of gravity SP0 and the motor center of gravity SPM is 290 mm.

The handle-side connection point 23 of the first vibration decoupler 20 is arranged at a distance hT0 of 120 mm from the machine center of gravity SP0. Consequently, a distance hMT between the motor center of gravity SPM and the handle-side connection point 23 is 170 mm, and the distance hGM between the motor center of gravity SPM and the handles 17*a*, 17*b* is 240 mm. A distance ht0 between the machine center of gravity SP0 and the tamping-pick-side connection point 22 of the first vibration decoupler 20 is 60 mm.

A distance h0F between the machine center of gravity SP0 and a force application point KP of the resulting eccentric force F provided by the vibration generator 6 is 383 mm.

The mode of operation of the hand-held tamping machine 1 is as follows:

The hand-held tamping machine 1 is in an operable state, with the fuel tank 32 half-filled and the ballast contact attachment 10 attached to the tamping pick tube 9. The user grips the hand-held tamping machine 1 by the handles 17*a*, 17*b* to carry it to the location of the track ballast 2 to be compacted. The motor 7 is started and drives the vibration generator 6 according to the power set by the power adjustment element 18. The vibration generator 6 causes the tamping pick 5 to vibrate. Steered by the user via the handles 17*a*, 17*b* and under the action of the weight of the hand-held tamping machine 1, the tamping pick 5 penetrates the track ballast 2.

The tamping pick 5 transmits the vibrational motion to the track ballast 2, which is compacted as a result. To support the tamping of the track sleeper 4, the user can swivel the hand-held tamping machine 1 about a horizontal axis oriented in particular parallel to the respective track sleeper 4. As a result, compaction of the track ballast 2 below the track sleeper 4 can be achieved particularly efficiently and reliably.

The vibrations excited at the handles 17*a*, 17*b* result at least in part from a rigid-body motion of the hand-held tamping machine 1. In FIG. 1, the shaft axis 16 is illustrated in the vertical orientation of the hand-held tamping machine 1. The shaft axis 16' drawn in obliquely to the vertical direction symbolizes the rigid-body motion of the track tamping machine 1 resulting from the eccentric force F. Here, the resulting vibration amplitude is shown greatly exaggerated. The limited rigidity of the hand-held tamping machine 1, in particular of the vibration decouplers 20, 21, is not taken into account in the rigid-body vibration. In a vibration nodal point SKP, the position of which depends on the mass distribution of the hand-held tamping machine 1, a minimum of the vibration amplitude prevails, in particular it is zero. Along the shaft axis 16, a distance hGP between the handles 17*a*, 17*b* and the vibration nodal point SKP is 60 mm. Due to the proximity of the handles 17*a*, 17*b* to the vibration nodal point SKP, the respective vibration amplitude prevailing at the handles 17*a*, 17*b* is particularly low.

The vibration decouplers 20, 21, 31 reduce the vibrations transmitted from the tamping pick 5 and/or the vibration generator 6 to the handle assembly 8, in particular the handles 17*a*, 17*b*, and the motor 7. As a result, the service life of the motor 7 can be extended due to reduced stresses. Furthermore, a considerable relief of the operator results.

The large distance hGM between the handles 17*a*, 17*b* and the motor center of gravity SPM, particularly in relation to the height H, has a particularly advantageous effect on the ease of use. The source of noise and/or exhaust emissions, when the motor is a gasoline engine, formed by the motor 7 is thus particularly far away from the user's head. In addition, the motor 7 is arranged particularly close to the machine center of gravity SP0, as a result of which the motor 7 is subjected to particularly low vibration loads due to increased inertial damping prevailing there.

It has been found that the reaction forces acting on the user via the handles 17*a*, 17*b* are dependent on the aforementioned distances, in particular the arrangement of the machine center of gravity SP0, the motor center of gravity SPM, the force application point KP and the handles 17*a*, 17*b* along the shaft axis 16. The prevailing selection of the distances results in particular in the arrangement of the handles 17*a*, 17*b* close to the vibration nodal point SKP. In the prevailing hand-held tamping machine 1, the reaction forces acting on the user or the vibration excitation at the handles 17*a*, 17*b* are particularly low. The hand-held tamping machine 1 is thus particularly user-friendly in operation.

The invention claimed is:

1. A hand-held tamping machine for compacting track ballast below a track sleeper, the tamping machine comprising:

a tamping pick for penetrating the track ballast;

a vibration generator for vibration excitation of said tamping pick, said vibration generator being configured such that forces generated for said vibration excitation of said tamping pick act perpendicular to a shaft axis;

a motor connected with said vibration generator via a drive shaft, said drive shaft having said shaft axis;

a handle assembly with at least one handle for steering the hand-held tamping machine during operation;

said at least one handle being arranged, along said shaft axis of said drive shaft, above at least one of:

a machine center of gravity of the hand-held tamping machine by at least 30% of an overall height of the hand-held tamping machine; or a motor center of gravity of said motor by at least 15% of the overall height of the hand-held tamping machine.

2. The hand-held tamping machine according to claim 1, wherein said at least one handle is arranged, along said shaft axis of said drive shaft, above the machine center of gravity by at least 40% of the overall height of the hand-held tamping machine.

3. The hand-held tamping machine according to claim 1, wherein along the shaft axis the machine center of gravity is arranged at a maximum of 60% of the overall height of the hand-held tamping machine below said at least one handle.

4. The hand-held tamping machine according to claim 1, wherein said at least one handle is arranged, along said shaft axis of said drive shaft, above the motor center of gravity by at least 20% of the overall height of the hand-held tamping machine.

5. The hand-held tamping machine according to claim 1, wherein a distance, along said shaft axis of said drive shaft, between said at least one handle and a vibration nodal point of the hand-held tamping machine provided by the vibration excitation by said vibration generator is a maximum of 15% of the overall height of the hand-held tamping machine.

6. The hand-held tamping machine according to claim 5, wherein the vibration nodal point is provided by at least one of a rigid-body motion or an elastic deformation of the hand-held tamping machine.

7. The hand-held tamping machine according to claim 1, comprising a first vibration decoupler operatively disposed between said tamping pick and at least one of the handle assembly or said motor.

8. The hand-held tamping machine according to claim 7, wherein said first vibration decoupler has a handle-side connection point and a tamping-pick-side connection point and at least one of said handle-side connection point or said tamping-pick-side connection point of said first vibration decoupler is arranged above the machine center of gravity.

9. The hand-held tamping machine according to claim 7, wherein a distance of said at least one handle from the motor center of gravity and a distance of the motor center of gravity from said handle-side connection point of said first vibration decoupler have a ratio in a range from 1:1 to 4:1.

10. The hand-held tamping machine according to claim 7, wherein along the shaft axis a distance between said tamping-pick-side connection point of said first vibration decoupler and the machine center of gravity is a maximum of 15% of the overall height of the hand-held tamping machine.

11. The hand-held tamping machine according to claim 7, wherein along the shaft axis a distance between said handle-side connection point of said first vibration decoupler and the machine center of gravity is a maximum of 20% of the overall height of the hand-held tamping machine.

12. The hand-held tamping machine according to claim 7, further comprising a second vibration decoupler and wherein at least one of said first vibration decoupler or said second vibration decoupler is arranged completely above the machine center of gravity.

13. The hand-held tamping machine according to claim 7, further comprising a second vibration decoupler operatively disposed between said handle assembly and at least one of said tamping pick or said motor.

14. The hand-held tamping machine according to claim 1, wherein said motor is a combustion engine or an electric motor.

15. The hand-held tamping machine according to claim 1, further comprising a tamping pick tube, and wherein said vibration generator is arranged at least in sections in said tamping pick tube.

16. The hand-held tamping machine according to claim 1, wherein along the shaft axis the machine center of gravity is arranged at a maximum of 70% of the overall height of the hand-held tamping machine below said at least one handle.

17. The hand-held tamping machine according to claim 1, wherein along the shaft axis the machine center of gravity is arranged at a maximum of 55% of the overall height of the hand-held tamping machine below said at least one handle.

* * * * *